US005213228A

United States Patent [19]

Chang

[11] Patent Number: 5,213,228

[45] Date of Patent: May 25, 1993

[54] TRASH TANK

[75] Inventor: Der-Feng Chang, Ping-Tung Hsien, Taiwan

[73] Assignee: Chin-Chiao Chou, Ping-Tung Hsien, Taiwan

[21] Appl. No.: 968,520

[22] Filed: Oct. 29, 1992

[51] Int. Cl.[5] ..... B65D 91/00

[52] U.S. Cl. ..... 220/404; 248/99; 248/147

[58] Field of Search ..... 220/404, 403, 908, 262, 220/263; 248/99, 147

[56] References Cited

U.S. PATENT DOCUMENTS

| | | | |
|---|---|---|---|
| 2,246,975 | 6/1941 | Geibel | 220/263 X |
| 3,226,070 | 12/1965 | Kurlander | 248/147 |
| 3,807,598 | 4/1974 | Nutt | 220/404 |
| 3,817,448 | 6/1974 | Schneider | 248/99 X |
| 3,836,037 | 9/1974 | Bass | 220/404 X |
| 4,537,377 | 8/1985 | Shewchuk | 248/99 |
| 5,125,526 | 6/1992 | Sumanis | 220/404 X |

*Primary Examiner*—Steven M. Pollard

*Attorney, Agent, or Firm*—Mason, Fenwick & Lawrence

[57] ABSTRACT

A trash tank includes a tank body which has a top open end and a partition which divides the tank body into an upper section and a lower section. The upper section receives a trash bag with a mouth disposed on a periphery of the top open end of the tank body. An elongated pedal member has a first end pivoted to an internal wall of the lower section of the tank body and a second end extending out of the tank body. A clamping device is provided for clamping detachably the mouth of the trash bag. The clamping device is disposed on the top open end of the tank body. An actuating device is provided for actuating the clamping device by means of pedaling the elongated pedal member. A fastening device is provided for fastening the mouth of the trash bag after the clamping device is detached from the mouth of the trash bag.

7 Claims, 5 Drawing Sheets

TRASH TANK

BACKGROUND OF THE INVENTION

1. Field of the Invention

This invention relates to a trash tank, more particularly to a trash tank which has provisions for fastening a mouth of a trash bag disposed in the trash tank.

2. Description of the Related Art

Conventionally, trash bags are disposed in trash tanks in order to protect the trash tanks from being contaminated. However, a person's hands are often contaminated by the trash in the trash bags and/or the dirt attached to the mouth of the trash bags when he/she ties up the trash bags.

SUMMARY OF THE INVENTION

It is therefore a main object of this invention to provide a trash tank which has provisions for fastening the mouth of a trash bag in the trash tank in order to prevent the user's hands from being contaminated.

Accordingly, the trash tank of this invention includes:

a tank body having a top open end and a partition provided therein, the partition dividing the tank body into an upper section and a lower section, the lower section of the tank body having a vertically extending slot, the upper section being adapted to receive a trash bag with a mouth disposed on a periphery of the top open end of the tank body;

an elongated pedal member having a first end pivoted to an internal wall of the lower section of the tank body and a second end extending out of the vertically extending slot of the tank body;

means for clamping detachably the mouth of the trash bag, the clamping means being disposed on the top open end of the tank body;

means for actuating the clamping means by means of pedaling the elongated pedal member; and means for fastening the mouth of the trash bag after the clamping means is detached from the mouth of the trash bag.

Other features and advantages of this invention will become apparent in the following detailed description of the preferred embodiments of this invention with reference to the accompanying drawings.

DETAILED DESCRIPTION OF THE PREFERRED EMBODIMENTS

Figure 1:
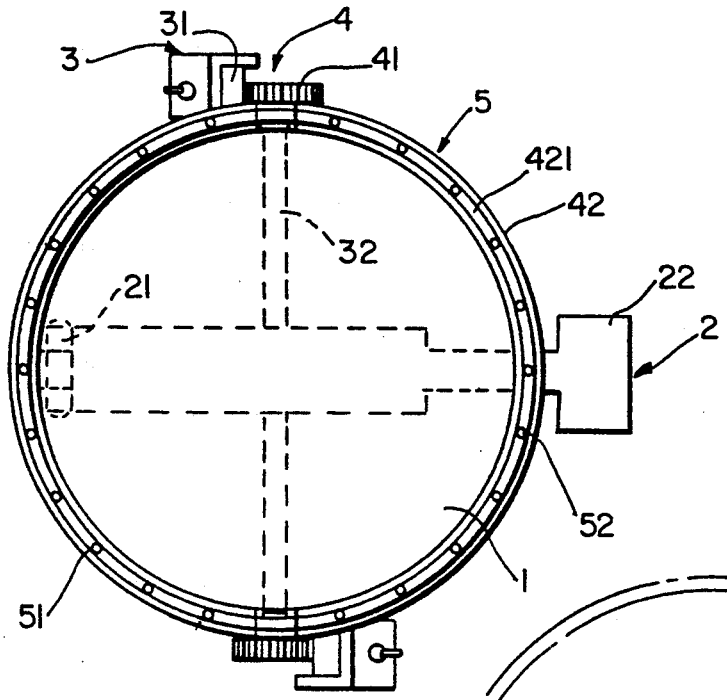
FIG. 1 is a top view of a first preferred embodiment of a trash tank of this invention.
Figure 2:
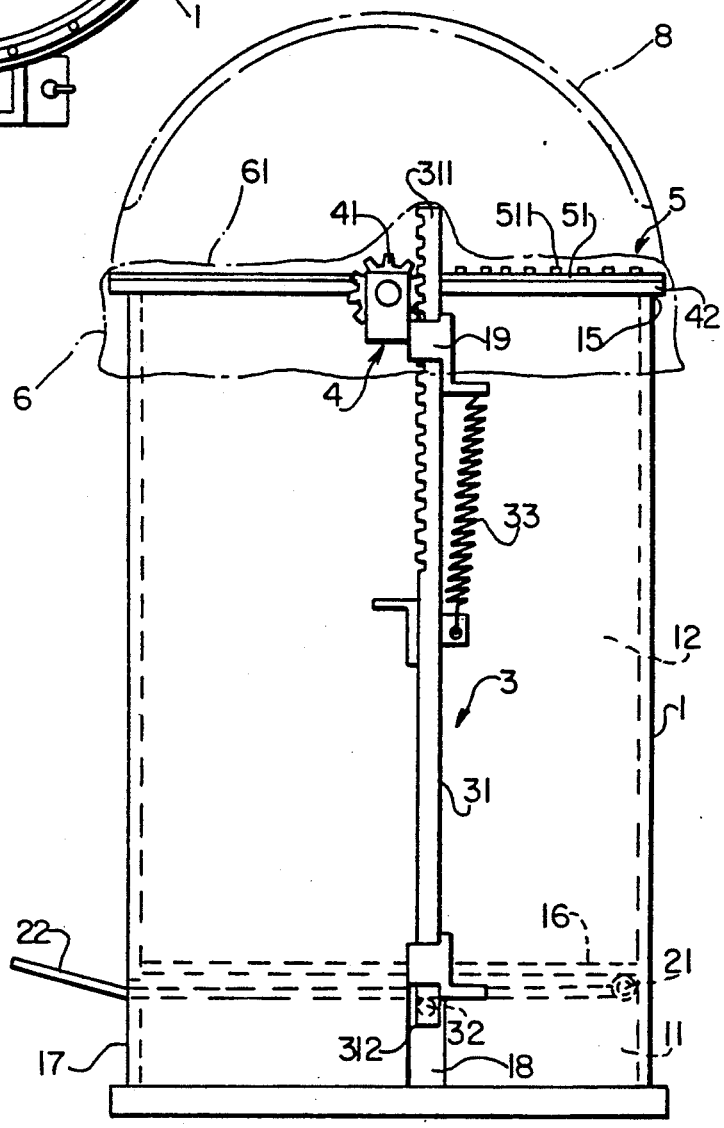
FIG. 2 is a side view of the first preferred embodiment of the trash tank of this invention.

FIGS. 1 and 2 show a top view and a side view of a first preferred embodiment of a trash tank of this invention. The trash tank includes a tank body (1) which has a top open end (15) and a partition (16) provided therein. The partition (16) divides the tank body (1) into an upper section (12) and a lower section (11). The lower section (11) of the tank body (1) has a vertically extending slot (17). The upper section (12) is adapted to receive a trash bag (6) with a mouth (61) covering the periphery of the top open end (15) of the tank body (1), as shown by the phantom line of FIG. 2.

An elongated pedal member (2) has a first end (21) pivoted to the internal wall of the lower section (11) of the tank body (1) and a second end (22) extending out of the vertically extending slot (17) of the tank body (1). A clamping means (4) is provided for clamping detachably the mouth (61) of the trash bag (6). An actuating means (3) is provided for actuating the clamping means (4) by means of pedaling the elongated pedal member (2). A fastening means (5) is provided for fastening the mouth of the trash bag (6) after the clamping means (4) is detached from the mouth (61) of the trash bag (6).

Figure 3:
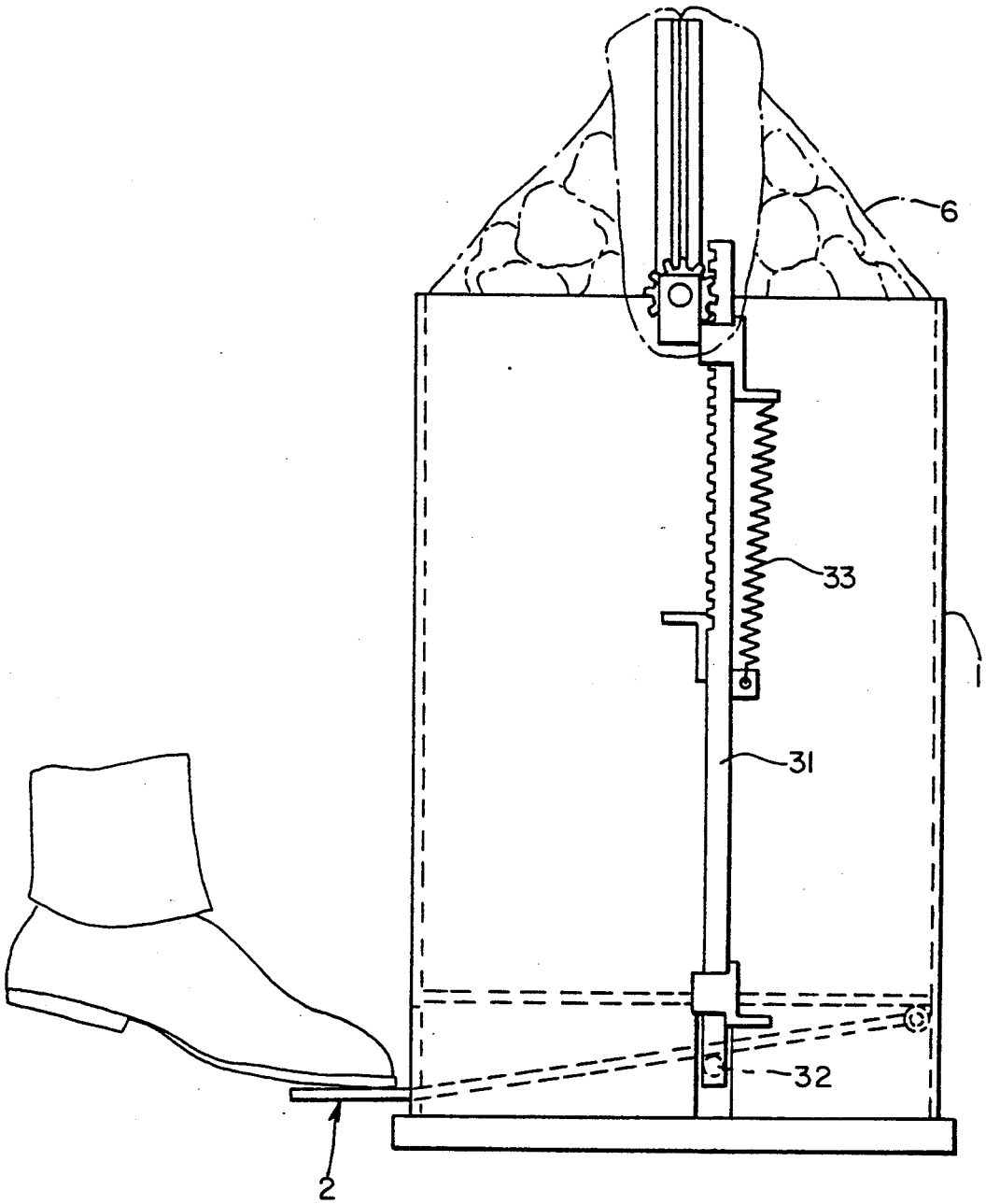
FIG. 3 is a schematic side view illustrating the clamping means of the trash tank of this invention when operated.
Figure 4:
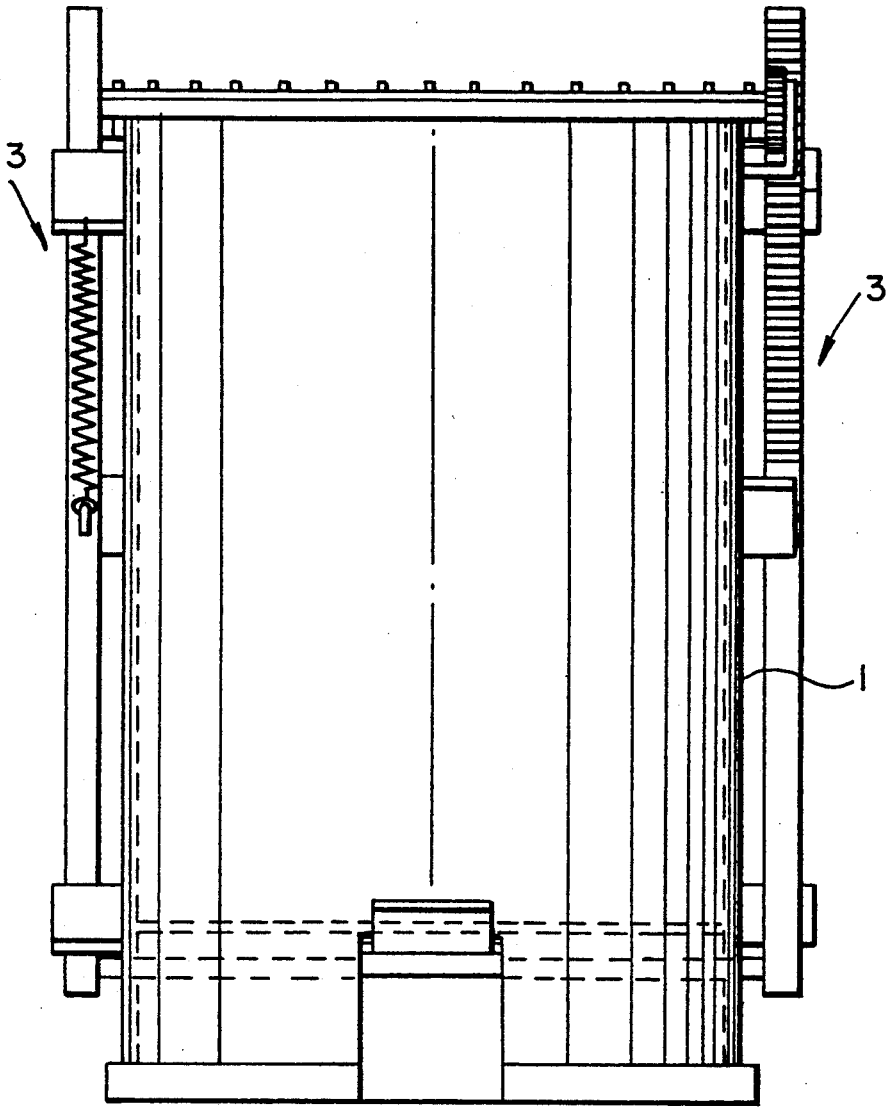
FIG. 4 is a front view of the first preferred embodiment of the trash tank of this invention.

The actuating means (3) includes a press rod (32) crossed with and disposed below the elongated pedal member (2). The press rod (32) has two ends extending out from two opposed vertically extending holes (18) (only one is shown in FIG. 2) in the lower section (11) of the tank body (1). Two racks (31) are vertically and oppositely mounted outside the tank body (1), as best illustrated in FIG. 4. Each of the racks (31) has an upper end (311) extending adjacent to the top open end (15) of the tank body (1) and further has a lower end (312) connected vertically to one of the ends of the press rod (32). Two spring members (33) (only one is shown in FIG. 2) are provided outside of the tank body (1) in order to urge the racks (31) to move upwardly. Each of the spring members (33) has a first end connected to a fixed mounting piece (19) provided adjacent to the top end (15) of the tank body (1) and a second end connected to one of the racks (31) so that the racks (31) can be moved down when the elongated pedal member (2) is pedaled down and can be moved up by the resilient force of the spring members (33) after the elongated pedal member (2) is released, as best illustrated in FIG. 3. A cap (8) may be provided on the top open end (15) of the trash tank, as shown in FIG. 2 by the phantom lines.

The clamping means (4) includes two gears (41) rotatably and oppositely mounted adjacent to the top open end (15) of the tank body (1). The gears (41) are respectively meshed with the upper ends (311) of the two racks (31). Each of the gears (41) is connected to a semi-circular member (42). The semi-circular members (42) are disposed on the open end of the tank body (1) and cooperatively forming a circle. The semi-circular members (42) are rotated toward each other when the racks (31) are moved downward by pedaling the elongated pedal member (2), thereby driving the gears (41) to rotate in a first direction, as best illustrated in FIG. 3. The semi-circular members (42) are separated from each other so as to form the circle, as best illustrated in FIG. 1, when the racks (31) are moved upward by releasing the elongated pedal member (2) so as to drive the gears (41) to rotate in a second direction opposite to the first direction.

Figure 5:
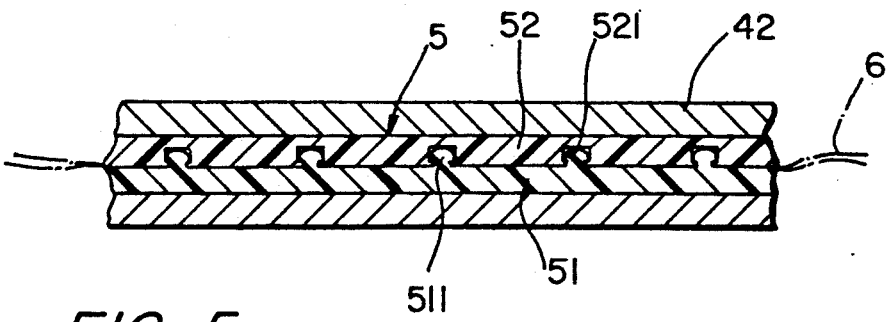
FIG. 5 is a sectional view of the clamping means and the fastening means of the first preferred embodiment of the trash tank of this invention in a clamping position.
Figure 6:
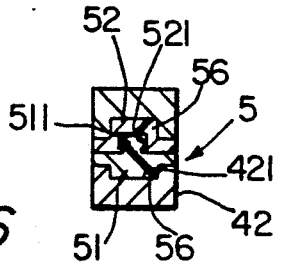
FIG. 6 is a cross sectional view of the clamping means and the fastening means of the first preferred embodiment of the trash tank of this invention in a clamping position.

Each of the semi-circular members (42) has a semi-circular groove (421) formed therealong. The semi-circular grooves (421) are aligned with each other when the semi-circular members (42) move toward and contact each other. The fastening means (5) includes two semi-circular plates (51, 52) respectively and detachably received in the semi-circular grooves (421) of the semi-circular members (42). Each of the semi-circular plates (51, 52) has an arcuate rib (56) formed at one side thereof and which is adapted to be inserted into one of the semi-circular grooves (421), as best illustrated in FIG. 6. One of the semi-circular plates (51) has projections (511) formed at the other side thereof, while the other one of the semi-circular plates (52) has a plurality of depressions (521) correspondingly formed at the other side thereof so as to engage the projections (511) when the two semi-circular members (42) are moved toward and contact each other, as best illustrated in FIG. 5. Therefore, the mouth (61) can be sealed without contaminating the user's hands.

In use, the semi-circular plates (51, 52) are inserted into the semi-circular grooves (421) of the semi-circular members (42). The trash bag (6) is then disposed in the trash tank of this invention with its mouth (61) covering the clamping means (4), as shown in FIG. 2. The elongated pedal member (2) is pedaled in order to move the semi-circular members (42) to engage each other, thereby enabling the semi-circular plates (51, 52) to close the mouth (61) of the trash bag (6).

Figure 7:
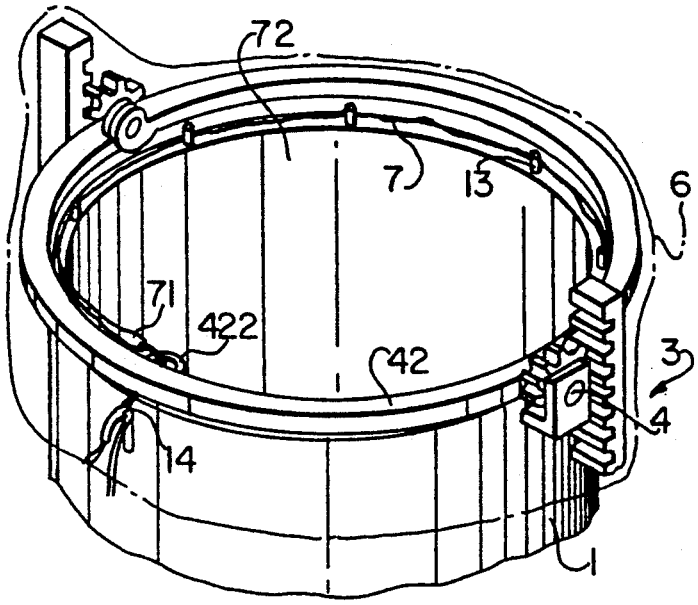
FIG. 7 is a fragmentary perspective view of a second preferred embodiment of the trash tank of this invention.
Figure 8:
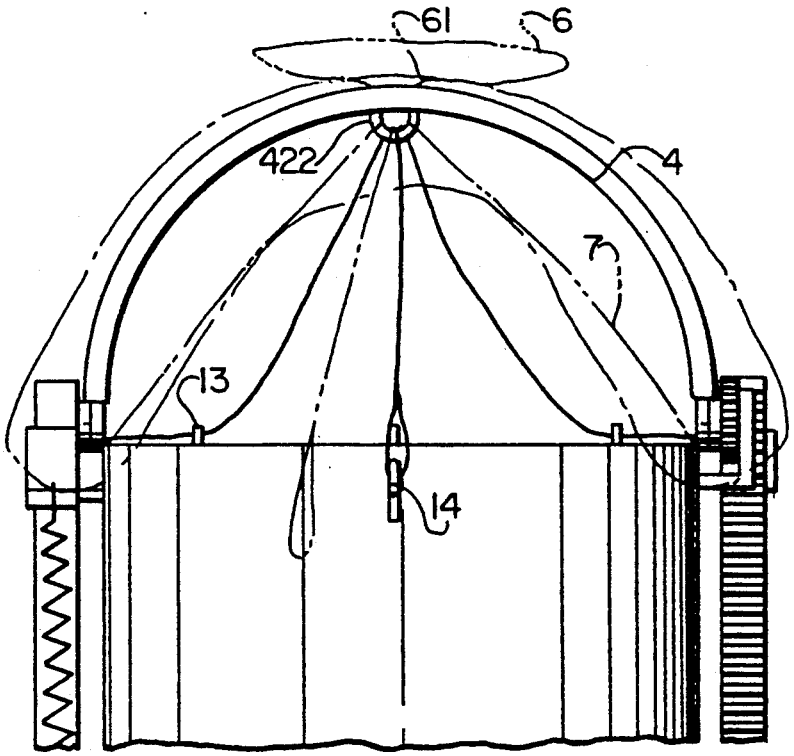
FIG. 8 is a fragmentary front view of the clamping means of the second preferred embodiment of the trash tank of this invention in a clamping position.

FIG. 7 shows a fragmentary perspective view of a second embodiment of the trash tank of this invention. In this embodiment, the construction of the trash tank is similar to that of the trash tank of the first embodiment except that the fastening means is a rope member (7) with two looped ends and a plurality of equally spaced positioning rods (13) provided on the internal face of the tank body (1) near the open end (15) of the tank body (1). The rope member (7) is disposed on the positioning rods (13). One of the semi-circular members (42) has a ring member (422) connected thereto. One of the looped ends passes through the other one of the looped ends (71) of the rope member (7) and the ring member (422) and is hooked on a hook member that is formed on the external face of the tank body (1). A slip knot is thus formed and a tie area (72) is formed at the top open end (15) of the tank body (1). When the clamping means (4) is in a clamping position, the user can pull the looped end of the rope member (7) outside the tank body (1) in order to tie up the mouth (61) of the trash bag (6), as best illustrated in FIG. 8.

Figure 9:
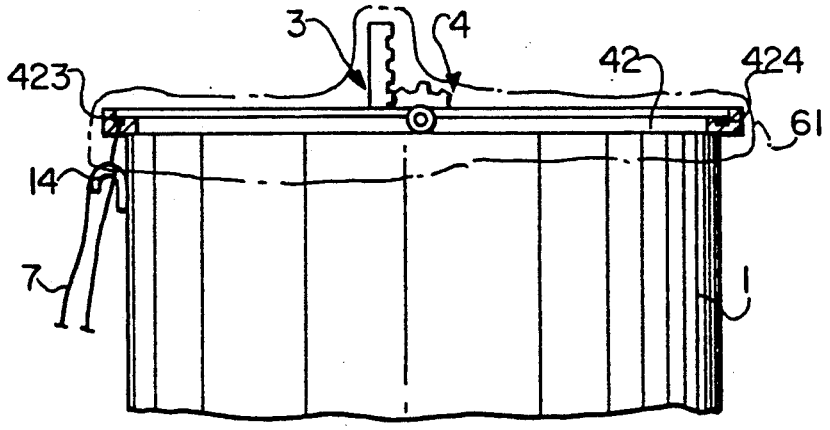
FIG. 9 is a fragmentary perspective view of a third preferred embodiment of the trash tank of this invention.
Figure 10:
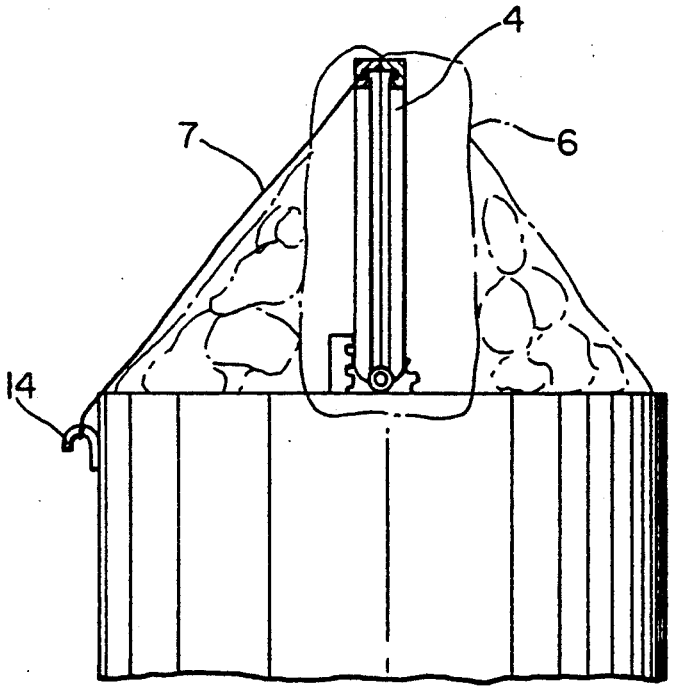
FIG. 10 is a fragmentary perspective side view of the third preferred embodiment of the trash tank of this invention.

FIG. 9 shows a fragmentary perspective view of a third embodiment of the trash tank of this invention. In this embodiment, the construction of the trash tank is similar to that of the trash tank of the first embodiment except that the fastening means is a rope member (7) with a looped end and each of the semi-circular members (42) has a stepped face which forms a shoulder (424) along an inner periphery thereof. The rope member (7) is disposed on the shoulders (424) of the semi-circular members (42). One of the semi-circular members (42) has a radial through hole (423) through which the ends of the rope member (7) are threaded. The looped end of the rope member (7) is hooked on a hook member (14) of the tank body as in the second embodiment. When the clamping means (4) is in a clamping position, the rope member (7) will not be clamped by the clamping means (4) and thereby, the user can pull the rope member (7) outside the tank body (1) in order to tie up the mouth (61) of the trash bag (6), as best illustrated in FIG. 10.

With this invention thus explained, it is apparent that numerous modifications and variations can be made without departing from the scope and spirit of this invention. It is therefore intended that this invention be limited only as indicated in the appended claims.

We claim:

1. A trash tank comprising:

a tank body having a top open end and a partition provided therein, said partition dividing said tank body into an upper section and lower section, said lower section of said tank body having a vertically extending slot, said upper section adapted to receive a trash bag with a mouth disposed on a periphery of said top open end of said tank body;

an elongated pedal member having a first end pivoted to an internal wall of said lower section of said tank body and a second end extending out of said vertically extending slot of said tank body;

means for clamping detachably said mouth of said trash bag, said clamping means being disposed on said top open end of said tank body;

means for actuating said clamping means by means of pedaling said elongated pedal member, said bag mouth closing upon actuation of said clamping means; and means for fastening said mouth of said trash bag after said clamping means is detached from said mouth of said trash bag.

2. A trash tank as claimed in claim 1, wherein said actuating means includes:

a press rod crossed with and disposed below said elongated pedal member, said press rod having two ends extending out from two opposed vertically extending holes in said lower section of said tank body;

two racks vertically and oppositely mounted outside said tank body, each of said racks having an upper end extending adjacent said top open said tank body and having a lower end connected vertically to one of said ends of said press rod; and two spring members each of which has a first end connected to said tank body and a second end connected to one of said racks in order to urge said racks to move upwardly, said racks being moved down when said elongated pedal member is pedaled down and being moved up by the resilient force of said spring members after said elongated pedal member is released.

3. A trash tank as claimed in claim 2, wherein said clamping means includes two gears rotatably and oppositely mounted adjacent to said top open end of said tank body, said gears being respectively meshed with said upper ends of said two racks, each of said gears being connected to a semi-circular member, said semi-circular members being disposed on said open end of said tank body and cooperatively forming a circle, said semi-circular member rotated toward each other when said racks are moved downward to drive said gears to rotate in a first direction and being separated from each other so as to form said circle when said racks are moved upward in order to drive said gears to rotate in a second direction opposite to said first direction.

4. A trash tank as claimed in claim 3, wherein each of said semi-circular members has a semi-circular groove formed therealong, said semi-circular grooves being aligned with each other when said semi-circular members move toward and contact each other, and wherein said fastening means includes two semi-circular plates respectively and detachably received in said semi-circular grooves of said semi-circular members, one of said semi-circular plates having projections formed thereon, and other one of said semi-circular plates having a plurality of depressions correspondingly formed thereon so as to engage said projections when said two semi-circular members are moved toward and contact each other.

5. A trash tank as claimed in claim 3, wherein said fastening means is a rope member and wherein said tank body has a plurality of equally spaced positioning rods provided on an internal face of said tank body near said open end of said tank body, said rope member being disposed on said positioning rods, one of said semi-circular members having a ring member connected thereto and through which said rope member is threaded.

6. A trash tank as claimed in claim 5, wherein said tank body has a hook member formed on an external face thereof so that one of the ends of said rope member can be hooked thereon.

7. A trash tank as claimed in claim 3, wherein said fastening means is a rope member and wherein each of said semi-circular members has a stepped face that forms a shoulder along a inner periphery thereof, said rope member being disposed on said shoulders of said semi-circular members, one of said semi-circular member having a radial through hole formed therein.

* * * * *